United States Patent [19]

Beck

[11] 4,114,338

[45] Sep. 19, 1978

[54] REINFORCING PLATE FOR OVERLAPPED JOINTS

[75] Inventor: David E. Beck, Middletown, Ohio

[73] Assignee: Armco Steel Corporation, Middletown, Ohio

[21] Appl. No.: 795,083

[22] Filed: May 9, 1977

[51] Int. Cl.[2] ..... E04B 7/00

[52] U.S. Cl. ..... 52/478; 52/483; 52/512; 52/551

[58] Field of Search ..... 52/483, 512, 509, 544, 52/549, 551, 552, 357, 359, 714, 715, 478, 712

[56] References Cited

U.S. PATENT DOCUMENTS

| | | | |
|---|---|---|---|
| 582,645 | 5/1897 | Heaton | 52/512 |
| 1,052,670 | 2/1913 | La Francis | 52/509 |
| 1,889,138 | 11/1932 | Wolfson | 52/512 |
| 2,919,663 | 1/1960 | Neahart | 52/483 |

*Primary Examiner*—Price C. Faw, Jr.
*Assistant Examiner*—Henry Raduazo
*Attorney, Agent, or Firm*—Melville, Strasser, Foster & Hoffman

[57] ABSTRACT

A reinforcing plate for use underneath two or more lapped thin gauge sheets to stiffen the lapped joint for prevention of damage to the seal from loading and to provide uniform compressant of sealant between the lapped sheets. The plate comprises an elongated planar member having pairs of parallel cuts evenly spaced along its length extending transversely from one edge thereof for substantially one half its width, the material between each of the pairs of cuts being bent into a down turned mounting flange of L-shaped cross section.

6 Claims, 6 Drawing Figures

REINFORCING PLATE FOR OVERLAPPED JOINTS

BACKGROUND OF THE INVENTION

1. Field of the Invention

This invention relates to a roof structure of the type using a plurality of roofing panels of metal channel section, adjacent margins of which are form-coupled to provide a functionally continuous roof, and more particularly to lapped joints of two or more over lapped building panels.

2. Description of the Prior Art

A typical metal building roof structure includes a plurality of spaced panels and a series of pairs of relatively stiff and rigid interlocked roof panels of channel configuration enclosing the space between the spaced purlins. The panels are almost always lapped and sealed, depending upon the length of the roof and the panel length. In general, the prior art fastens lapped joints directly to structural members, such as the spaced purlins. In many prior art systems with hidden clip fasteners, stitch screw or rivets are employed to fasten lapped metals together with no uniform compression of the sealant in the laps and no provision for movement of the roof sheets independent of the underlying structure.

SUMMARY OF THE INVENTION

The present invention provides a reinforcing plate for use underneath two or more lapped thin gauge sheets, such as lapped and sealed roof panels, to stiffen the lapped joint for prevention of damage to the seal from loading and to provide uniform compressant of sealant between lapped sheets. The reinforcing plate comprises an elongated, rectangular planar member having pairs of parallel cuts evenly spaced along its length extending transversely from one long edge thereof for substantially one half its width. The material between each of the pairs of cuts is bent into a down turned mounting flange of L-shaped cross section. A first portion of each leg of the down turned mounting flange extends downwardly from the planar member and a second portion thereof extends from the first portion at substantially right angles so as to be substantially parallel to the planar member. Each of the second portions of the down turned mounting flanges is provided with an aperture therein for the passage therethrough of fastening means, whereby the planar member is attached to an underlying structural member through an elongated hole in the bottom most member.

A thermal spacer is utilized between the planar member and the underlying structural member, the thermal spacer having apertures therein for receipt of the down turned mounting flanges. The first portion of the down turned mounting flange is of a length to extend through the apertures in the thermal spacer such that the second portion thereof is contiguous with the underlying structural member.

The apertures in the second portions of the mounting flanges may be slots so as to permit free movement of the lapped sheets independent of movement of the underlying structural member to which the mounting flanges are attached.

The other long edge of the planar member may be provided with a downwardly depending flange extending the length of the member.

Finally, the planar member is substantially wider than the width of the underlying structural member.

The reinforcing plate of the present invention reinforces lapped joints to prevent separation of the sealant, once the lapped joints are fastened securely. The slotted down turned mounting flanges, connected to the underlying structural member, such as a purlin or girt, with a shoulder fastener, allow independent movement of the lapped sheets as related to the structural supports. Finally, the reinforcing plate of the present invention acts as a rigid back-up member to insure uniform compression and dispersement of the sealant or gasket between the lapped materials.

BRIEF DESCRIPTION OF THE DRAWING

FIG. 2 is a fragmentary perspective view of a roof structure of FIG. 1 as secured to an underlying purlin.

FIG. 3 is a cross sectional view of the structure according to FIG. 2.

DESCRIPTION OF THE PREFERRED EMBODIMENTS

Figure 1:
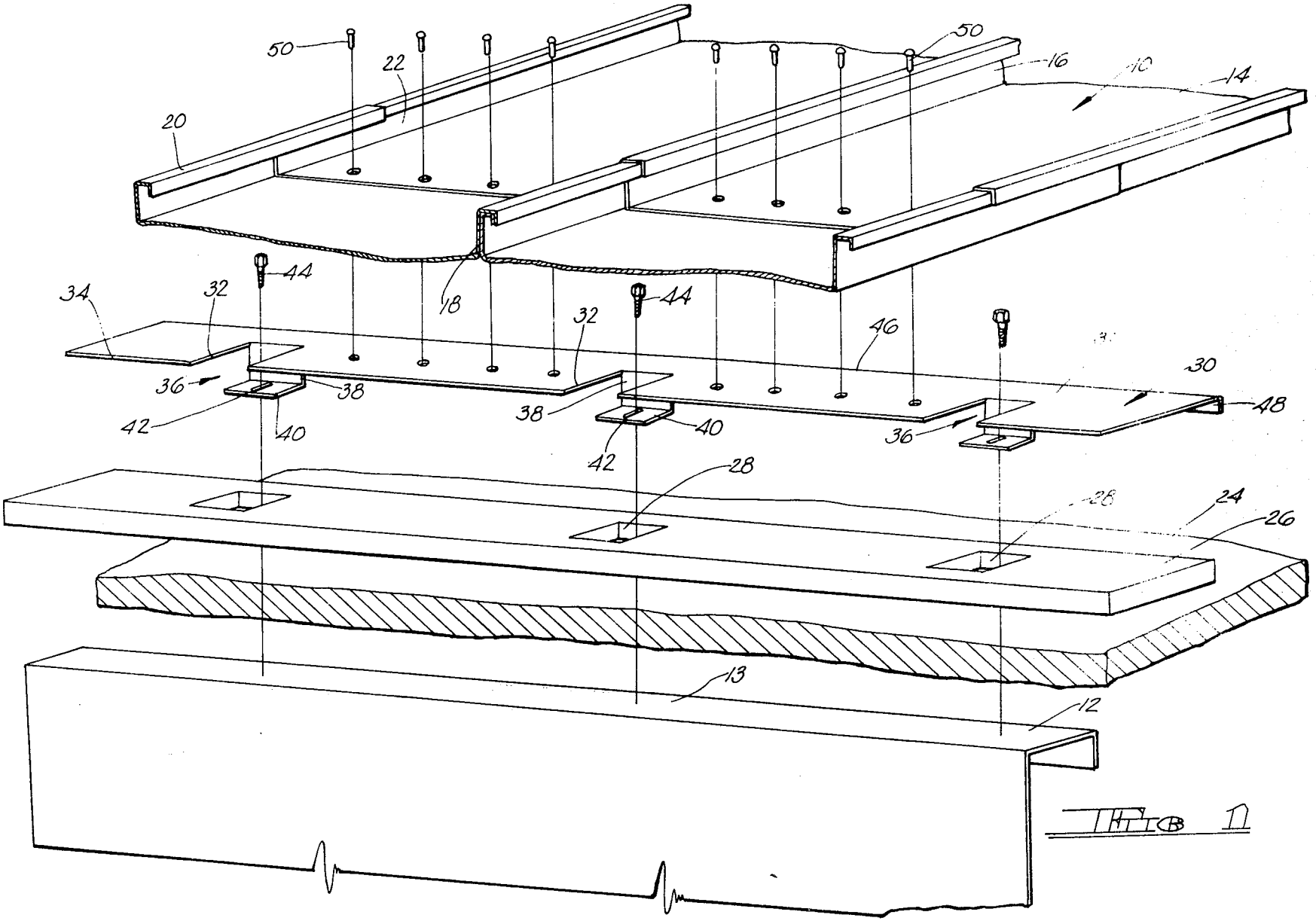
FIG. 1 is an exploded, perspective view of an exemplary roof structure which utilizes the reinforcing plate of the present invention.

Referring now to the drawings, and in particular to FIG. 1, it will be seen that a typical building structure incorporating the present invention may include a series of pairs of relatively stiff and rigid interlocked metal panels 10 of channel configuration and self-supporting capacity affixed to and closing the space between spaced supporting members, such as, for example, the purlin or girt 12. Clip connectors (not shown) anchor the coupled panels 10 to the purlins 12.

Each of the panels 10 is provided with a central web surface 14 and a pair of side walls 16 projecting outwardly from opposing edges of the web surface 14 to form inverted channel-shaped ribs along the abutting edges of the panels 10 adapted to form rib joints 18. Each rib joint 18 has an inverted channel shaped female member 20 secured along the edge of one panel 10 and a corresponding inverted channel-shaped male member 22 secured along the edge of an adjacent panel 10.

Suitable insulation 24, such as blanket or roll insulation, is installed in the normal fashion over the supporting members or purlins 12. Thermal spacers 26, preferably of a dense, non-metallic substance such as, for example, urethane, having apertures or slots 28 therein, are laid on the spaced members or purlins 12.

Figures 4, 5, 6, 7, 8:
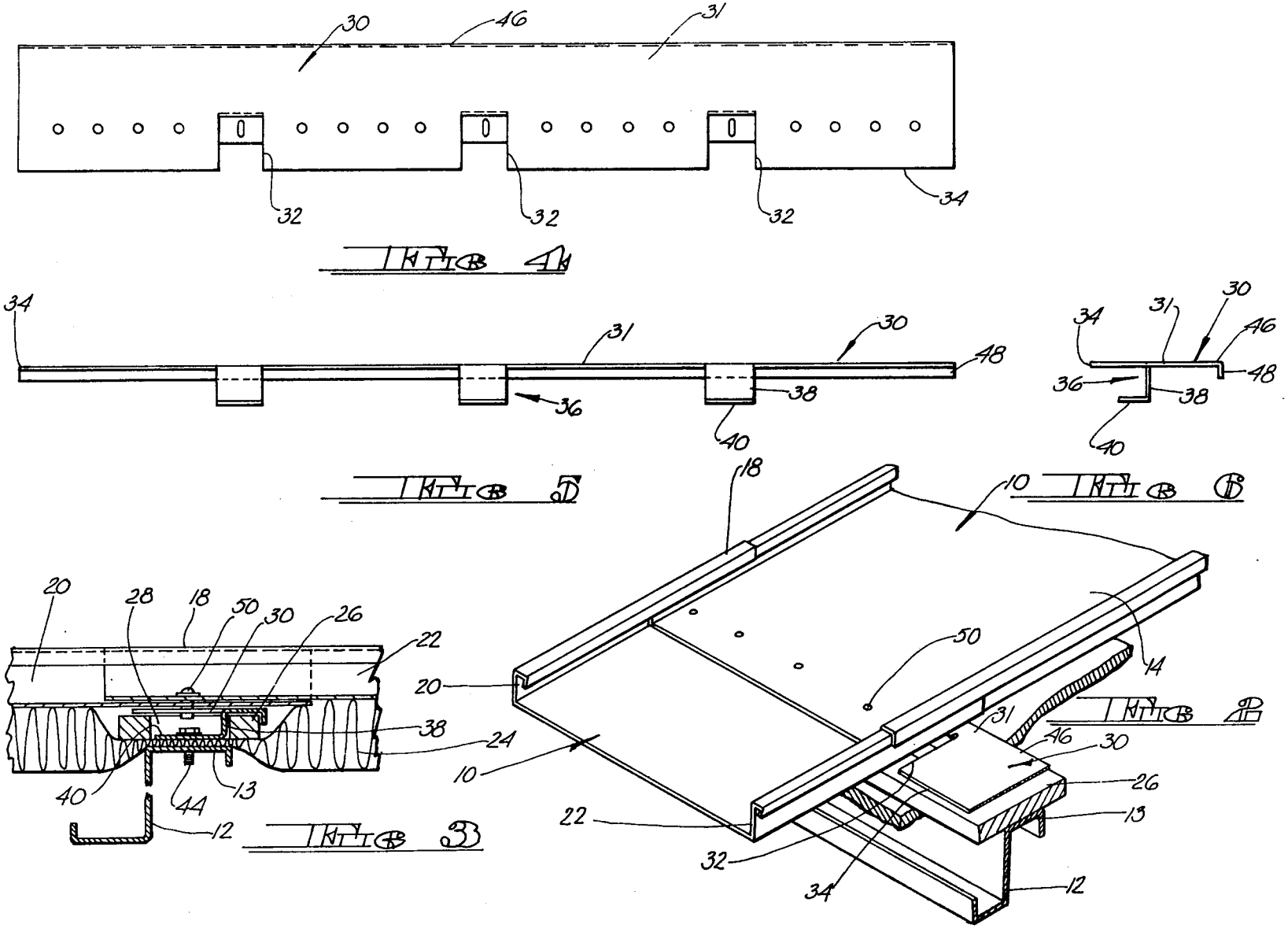
FIG. 4 is a plan view of the reinforcing plate of the present invention.
FIG. 5 is a side elevational view of the reinforcing plate of the present invention.
FIG. 6 is an end elevational view of the reinforcing plate of the present invention.

The reinforcing plate 30 of the present invention is placed over the thermal spacers 26. As can best be seen in FIGS. 4 through 6, the reinforcing plate 30 comprises an elongated, rectangular planar member 31 having pairs of parallel cuts 32 evenly spaced along its length extending transversely from one long edge 34 thereof for substantially one half its width. The material between each of the pairs of cuts 32 is bent into a down turned mounting flange 36 of L-shaped cross section. A first portion 38 of the down turned mounting flange 36 extends downwardly from the planar member 31 and a second portion 40 thereof extends from the first portion 38 at substantially right angles so as to be substantially parallel to the planar member 31. The down turned mounting flanges 36 extend through the apertures 28 in the thermal spacer 26. Accordingly, the first portion 38 of the mounting flanges 36 is of a length to extend through the apertures 28 in the thermal spacer 26 so that the second portion 40 thereof is contiguous with the supporting member or purlin 12.

The second portion 40 of each down turned mounting flange 36 is provided with an aperture 42 therein for the passage therethrough of fastening means, such as the screws 44, whereby the reinforcing plate 30 is secured to the structural member or purlin 12. In practice, the apertures 42 are slotted so as to permit free movement of the overlapped panels 10 independent of movement of the structural member or purlin 12 to which the mounting flanges 36 are attached.

It will, of course, be understood that the apertures 42 need not be slotted in order to permit free movement of the overlapped panels, which are attached to the reinforcing plate 30, independent of movement of the structural member or purlin 12 to which the mounting flanges 36 of the reinforcing plate 30 are attached. For example, this could be accomplished by allowing the first portions 38 of each mounting fastener 36 to bend and deflect as the panels 10 move independently of the structural members 12, as by the use of special "spring-type" steels which prevent fatique failure of the bending steel. Additionally, composites of rubber or other flexible materials could be made to achieve these results, but would result in extra costs.

It will, of course, be seen that in the preferred embodiment of the reinforcing plate 30 of the present invention, the first portion 38 of the mounting flange 36 is substantially normal to the planar member 31.

It will also be seen that the width of the planar member 31 of the reinforcing plate 30 of the present invention is substantially wider than the width of the supporting member or purlin 12, such as the flange 13. This is required to have the necessary surface area support under the entire lapped joint of the panels 10 to enable sealant flow throughout, not just in the immediate vicinity above the supporting member or purlin 12.

The other long edge 46 of the planar member 31 of the reinforcing plate 30 of the present invention may be provided with a downwardly depending flange 48 extending the length of the planar member 31. The purpose of the flange 48, as best seen in FIG. 3, is to properly position the reinforcing plate 30 with respect to the thermal spacer 26.

After the mounting flanges 36 of the reinforcing plate 30 of the present invention are secured to the supporting member or purlin 12 by the fastener means 44, the lapped panels 10 are secured by screws or rivets 50 to the reinforcing plate 30.

The reinforcing plate 30 of the present invention is of special value on building covering systems having hidden clip fasteners where lapped panel sections are spaced away from any structural or framing members. The reinforcing plate 30 provides auxiliary backing support to lapped and sealed sections to insure uniform compression of sealants or gaskets, to keep the joints tight under intermittent loading, such as foot traffic, etc., and to permit movement of the overlapped panels or sheets 10 independent of the movement of the underlying structural member or purlin 12. The reinforcing plate 30 of the present invention reinforces lapped joints to prevent separation of the sealant once the lapped joints are fastened securely. The mounting flanges 36 with the slots 42 in the second portion 40 thereof, connected to the supporting member or purlin 12 with a shoulder fastener 44, allow independent movement of the over lapped panels as related to the underlying structural member or purlins 12. Finally, the reinforcing plate 30 of the present invention acts as a rigid back-up member to insure uniform compression and dispersement of the sealant or gasket between the lapped panels 10.

While certain preferred embodiments of the present invention have been specifically illustrated and described, it is understood that the invention is not limited thereto, as many variations will be apparent to those skilled in the art, and the invention is to be given its broadest interpretation in the terms of the following claims.

I claim:

1. In a roof structure, the combination of a plurality of spaced purlins, a series of pairs of relatively stiff and rigid interlocked roof panels of channel configuration and selfsupporting capacity affixed to and enclosing the space between said spaced purlins, said panels being lapped and sealed, a thermal spacer sandwiched between each of said spaced purlins and said panels at the lapped joints thereof, said thermal spacer having apertures therein, a reinforcing backing plate overlying said thermal spacer for providing auxiliary backing support to said lapped and spaced panels to insure uniform compression of sealants, to keep the lapped joints tight under intermittent loading and to permit movement of said panels independent of said purlins, said backing plate comprising an elongated, rectangular planar member having pairs of parallel cuts evenly spaced along its length extending transversely from one long edge thereof, the material between each of said pairs of cuts being bent into a down turned mounting flange of L-shaped cross section, a first portion of said mounting flange extending downwardly from said planar member and a second portion of each mounting flange extending from said first portion so as to be substantially parallel to said planar member, said down turned mounting flanges extending through said apertures in said thermal spacer such that said second portion thereof is contiguous with said underlying purlin, each of said second portions having an aperture therein for the passage therethrough of fastening means, whereby said planar member is attached to said purlin.

2. The roof structure according to claim 1, wherein said first portion of said down turned flange is substantially normal to said planar member and wherein said second portion of said down turned flange is substantially normal to said first portion thereof.

3. The roof structure according to claim 2, wherein said apertures in said second portion of each said down turned mounting flange is slotted to permit free movement of said planar member independent of movement of said purlins to which said mounting flanges are attached.

4. The roof structure according to claim 3, wherein the other long edge of said planar member is provided with a downwardly depending flange extending the length of said member.

5. The roof structure according to claim 4, wherein the width of said planar member is substantially wider than the width of said purlins.

6. The roof structure according to claim 5, wherein said pairs of parallel cuts extend transversely from one long edge of said planar member for substantially one half its width.

* * * * *